US005816171A

United States Patent [19]

Fitts, Jr.

[11] Patent Number: 5,816,171

[45] Date of Patent: Oct. 6, 1998

[54] ROTATING ILLUMINATING TABLE

[76] Inventor: Charles K. Fitts, Jr., 40 Weston Rd., Lincoln, Mass. 01773

[21] Appl. No.: 721,213

[22] Filed: Sep. 26, 1996

[51] Int. Cl.[6] ..... A47B 85/00

[52] U.S. Cl. ..... 108/23; 108/20

[58] Field of Search ..... 108/23, 20, 22, 108/21

[56] References Cited

U.S. PATENT DOCUMENTS

| | | | |
|---|---|---|---|
| 1,971,391 | 8/1934 | Bilton | 108/23 X |
| 2,652,657 | 9/1953 | Joy | 108/23 |
| 3,103,899 | 9/1963 | Macken | 108/23 X |
| 3,154,865 | 11/1964 | Conner | 108/23 X |
| 3,624,381 | 11/1971 | Pollack et al. | 108/23 |
| 3,867,622 | 2/1975 | Billman | 108/23 |

*Primary Examiner*—Jose V. Chen
*Attorney, Agent, or Firm*—John P. McGonagle

[57] ABSTRACT

A rotating illuminating table with a circular top portion connected to a stem portion which is mounted in a circular base portion. The circular base portion contains light bulbs and a rotational drive for rotating a top surface which is contained within the base portion. Colored glass and beads are randomly located on the top surface. Light shines from the base portion through the colored glass, into and through the top portion. The light shines through a plurality of spokes located on the bottom of the top portion and through glass plates which rest on top of the spokes. The glass plates can be multiple colors providing a specific desired color effect. The light illuminates the objects on top of the table and creates a changing colored pattern on the ceiling.

8 Claims, 4 Drawing Sheets

ROTATING ILLUMINATING TABLE

BACKGROUND OF THE INVENTION

This invention relates to display tables, and more particularly to display tables that are rotatable and illuminated.

Display tables have existed for a very long time in the art. Merchandisers and individuals have a need to display goods they are trying to sell or artifacts of which they are especially proud.

There remains a need for improved display tables that rotate and project changing colored lighting on the objects on the table surface from below the objects and also on the ceiling of the room. There remains a need for improved display tables which fascinate and relax a viewer and can be selectively controlled to give a desired colored visual effect. There remains a need for an improved illuminated display table where the lighting color can be custom chosen to suit the desires or colors of the objects displayed. There remains a need for an illuminated display table that can be quickly and easily modified and/or moved from one location to another.

Merchandisers need to display goods to customers. A traditional table will hold goods, but does not allow a customer to examine all sides of a product without touching the product. The displaying and handling of goods can be a difficult dilemma for a retailer where the goods on display are expensive or breakable. A merchandiser is caught between wanting to display and sell a delicate breakable product and not wanting a customer to examine or handle and possibly break a very delicate product.

Some display objects will also begin to break down or decompose from the oils and moisture that can be found on an examining persons skin. Some display goods become dirty from customer handling of the objects or goods. For these reasons, a person displaying merchandise would not want persons touching or holding an object on display. A merchandiser cannot afford to have expensive delicate objects broken and dirtied. A merchandiser cannot afford a lack of goods on display for fear of lost sales.

A merchandiser also wants to catch a customers eye and have the displayed goods look appealing to a customer. One way to do this is to shine display lights onto the goods or table holding the goods highlighting the goods with lights of different colors. External multi-colored lighting can be used to illuminate the goods. External lighting requires adjustment to get the angle and focus of the display lights correct. Once adjusted properly, the display is merely a static display. If a display needs to be moved, the lighting, angle and focus must be readjusted. If different colored goods were then to be displayed, the light bulbs would have to be changed to create the desired color coordinated lighting effect.

If the lighting is not directed from directly overhead, a person examining the goods could step into the path of the light rays. This would cause shadows on the goods and diminish the visual appeal of the goods. If the lighting were directed from below the objects, a customer viewing the goods would not create a shadow on the goods. Preferably the different colored lighting would move and change colors catching the eye and attracting more attention to the goods displayed on the table.

Homeowners also have items or artifacts that they may want to display for themselves or to visitors to their homes. A homeowner may not want a visitor to handle an extremely valuable delicate object for fear the object will be broken. The homeowner may want to view all sides of an object themselves without having to handle the object and risk breaking it. Oils and moisture from handling can also cause an object to break down or tarnish and dirty hands can also soil a treasured object. A homeowner needs a rotating illuminating table to display items in the home. The homeowner would also find it beneficial to have the lighting shine on the display objects from below. This would eliminate the shadows that would occur with external lighting sources.

It would be ideal if a table would rotate to display merchandise and goods so customers and others could view all sides of an object without having to handle the goods. It would be ideal if a person displaying goods could highlight the goods with lighting that would catch a viewers eye by moving and changing colors. It would be ideal if this table and lighting could be easily set up and/or relocated with no or little need for adjustment. It would be ideal if the lighting was generated from below the objects on display such that a person examining the goods would not cast a shadow on the goods upon examination. It would be ideal if the lighting could easily be changed in color to highlight goods of different colors.

For the foregoing reasons, there is a need for a Rotating Illuminating table.

SUMMARY OF THE INVENTION

In view of the foregoing disadvantages inherent in the area of multicolored rotating illuminating display tables this invention shows a Rotating Illuminating Table with changing multicolored lighting.

A rotating illuminating table is described. It comprises a circular top portion connected to a stem portion which is mounted in a circular base portion. The circular base portion contains an illumination means and a rotation means for rotating a circular top surface of clear glass which is located above the illumination means. The clear glass top surface has a plurality of multicolored mostly transparent glass pieces and is contained within the base portion. As the light travels through the glass pieces it takes on the color of the glass pieces through which it passes. The multicolored light continues up towards the top portion. The light travels through spaces between spokes, the glass plates, the cover plate and illuminates the objects on the cover plate top surface. The light continues through the top portion and will illuminate a multicolored pattern on the ceiling provided the ceiling is of an appropriate distance from the illuminated rotating table. The glass plates can be user chosen multiple colors providing a specific desired effect.

A first object of the invention is to provide a display table for merchandisers and others that would allow examination of all sides of an object without picking it up. This decreases the chances that the object would be broken or oils or moisture from an examiners hands would tarnish or damage the object.

Another object of the invention is to provide an eye catching display table that provides additional lighting to the objects on display on the table such that a customer is interested in visually examining the display objects.

It is yet another object of the invention to provide an eye catching display table that provides changing multicolored lighting to the objects on display such that a customer is interested in visually examining the display objects.

It is another object of the invention to provide the illumination from below the objects on display such that persons walking by the display table or standing near the table would not cast shadows on the displayed goods.

It is a still further object of the invention to provide a rotating changing multicolored display table that is easy to set up and move from location to location.

It is yet a further object of this invention to provide rotating illuminating table that provides an interesting changing pattern and color of light on a ceiling.

These together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this invention.

DETAILED DESCRIPTION OF THE INVENTION

Figure 1:
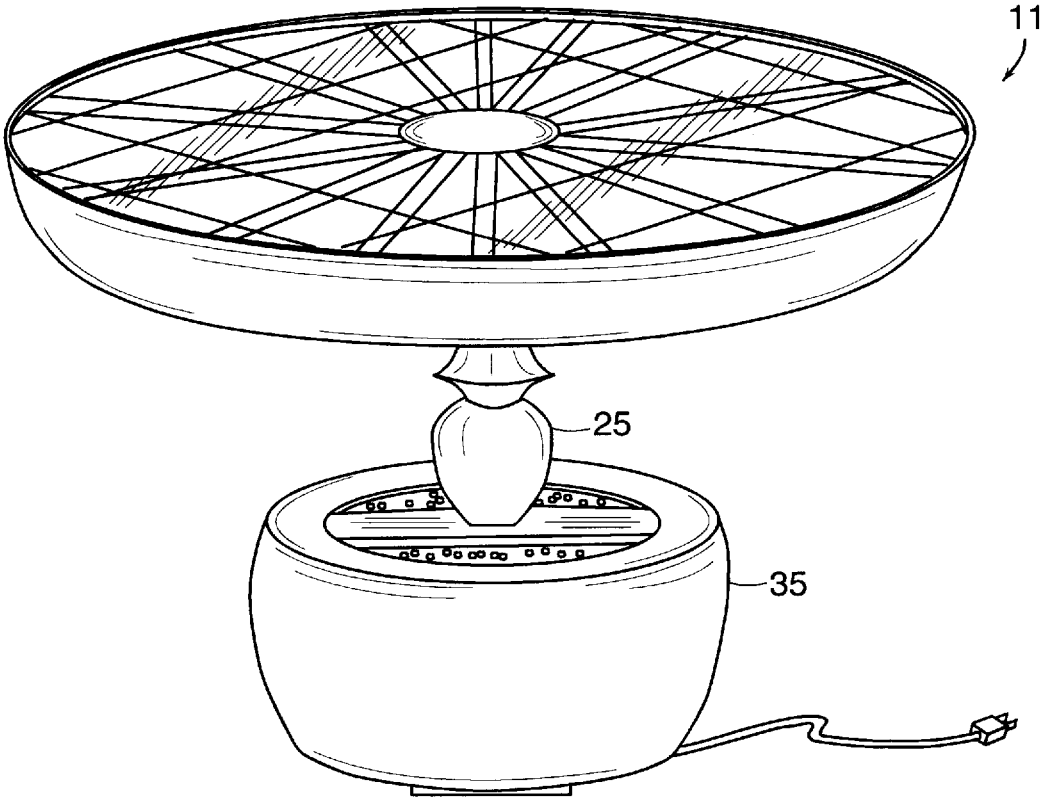
FIG. 1 is a perspective view of the invention.
Figure 2:
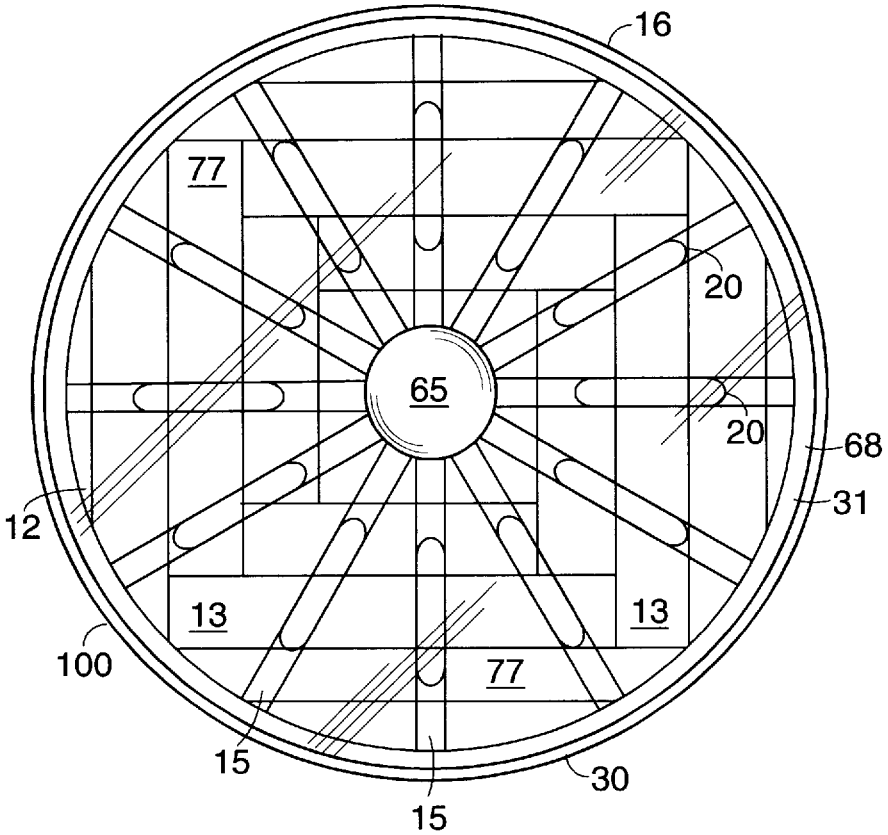
FIG. 2 is a top view of the invention.
Figure 3:
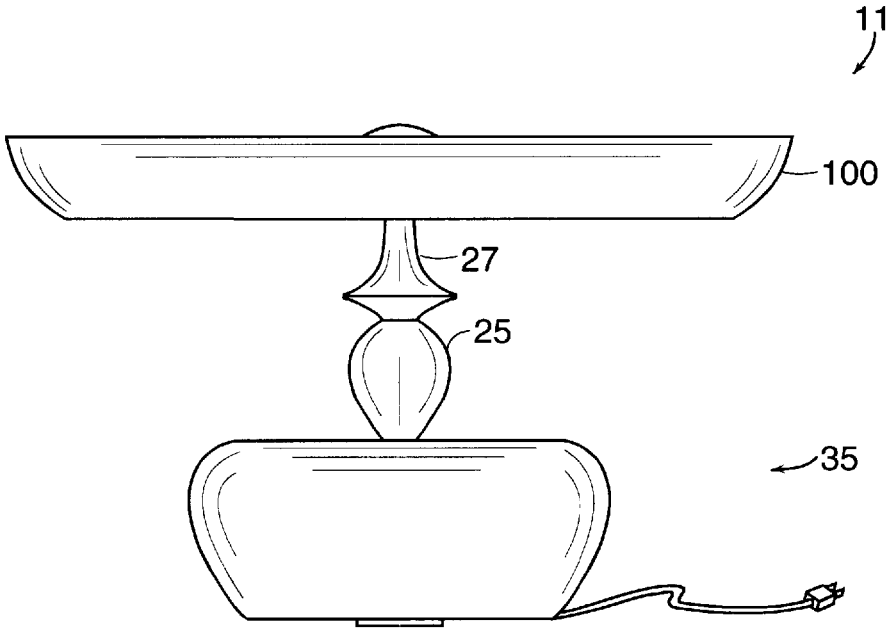
FIG. 3 is a side elevational view of the invention.
Figure 4:
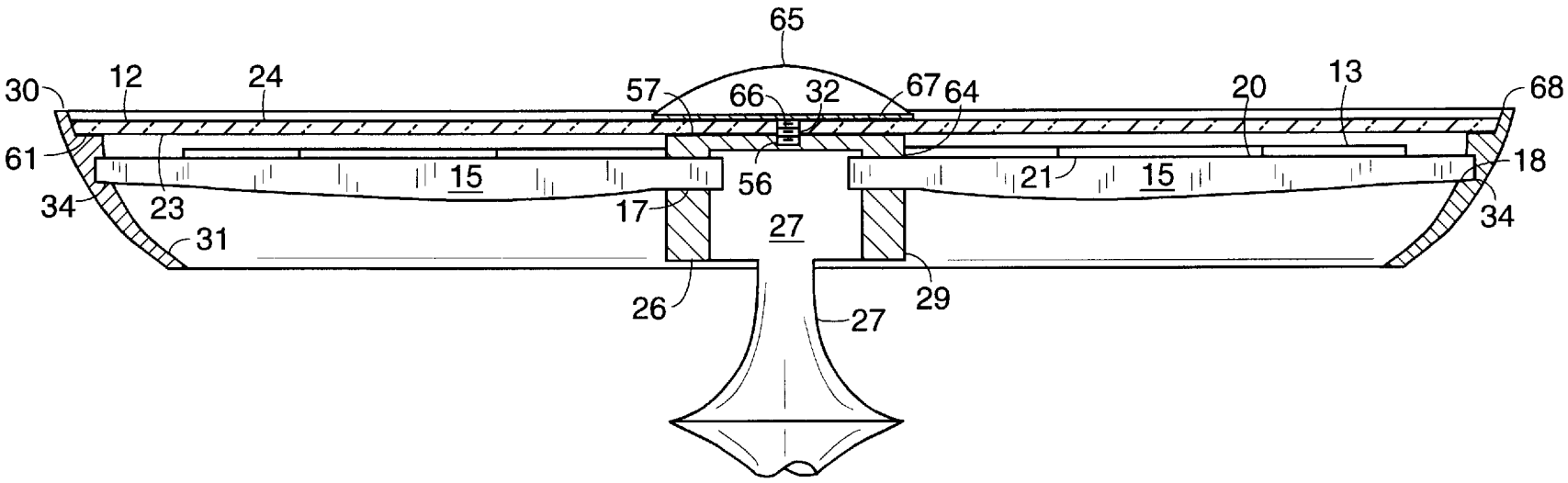
FIG. 4 is a cross-sectional view of the top portion of the invention.
Figure 5:
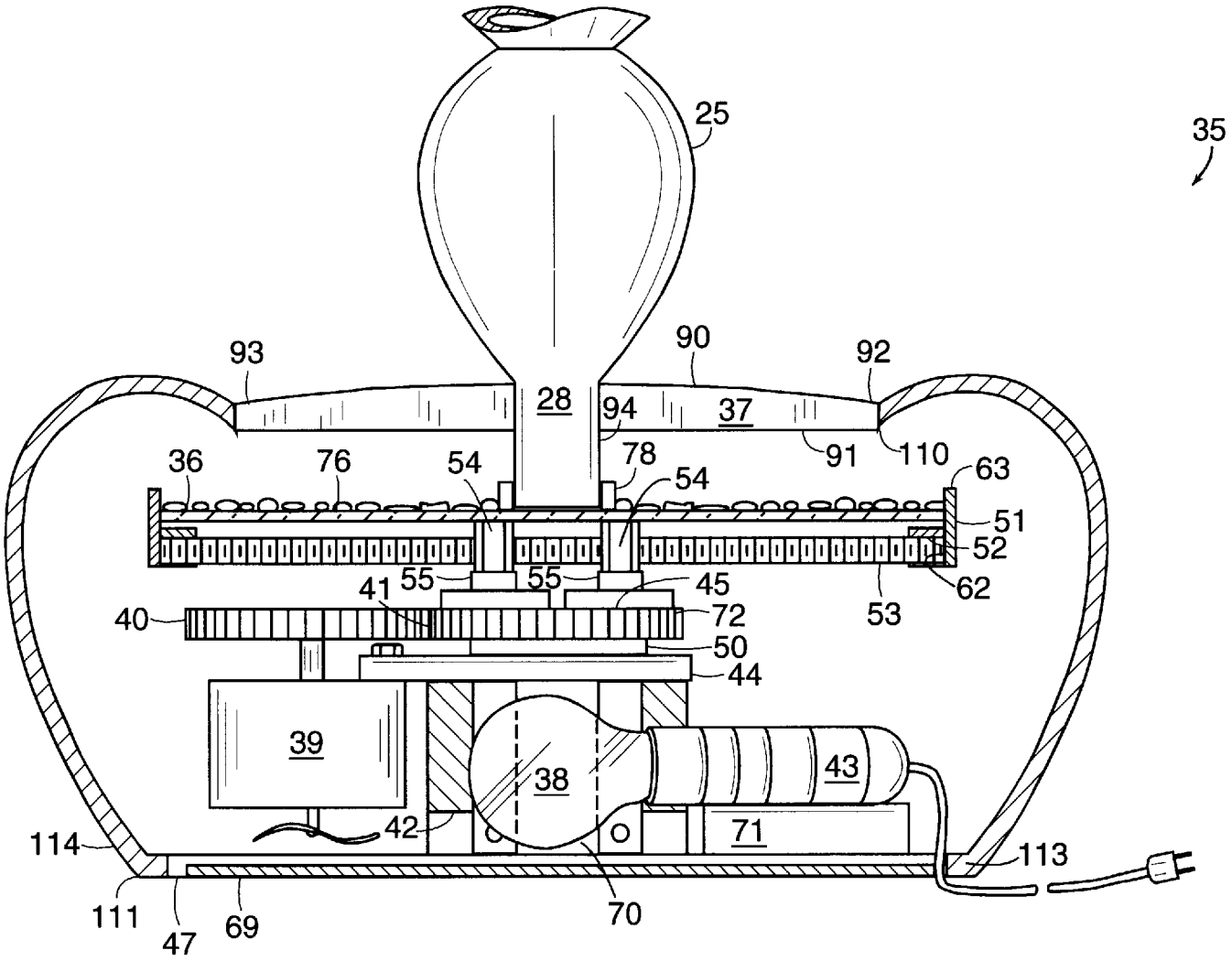
FIG. 5 is a cross-sectional view of the base portion of the invention.

Referring to the drawings in detail wherein like elements are indicated by like numerals, the rotating illuminating table of the present invention has a circular top portion 11 attached to a first end 27 of a stem portion 25. The second end 28 of the stem portion 25 is affixed to a lower cross member 47 of a circular base portion 35. The base portion 35 rests over two pieces of heat resistant material 69 affixed to an attachment plate 70.

The top portion 11 has a stem hub 26 which fits over and is rotatably attached to the first end 27 of the stem portion 25. The stem hub 26 is primarily cylindrically shaped with a longitudinal axis and a top surface 57 with a cap hole 56 centrally located on the top surface 57, and a stem hole 44. The stem hub 26 has a plurality of equally spaced spoke inner holes 64 around the circumference of the hub outer surface 29 perpendicular to the longitudinal axis. The spoke inner holes 64 run from the outer surface 29 through to the stem hole 44.

A plurality of spokes 15, in this embodiment twelve, are inserted perpendicular to the hub outer surface 29 and extend away from the stem hub 26, where the first spoke end 17 is inserted into the spoke inner hole 64. The spokes 15 are primarily cylindrical in shape with a tapered cross section and a flat spoke top surface 20 which faces up when the spokes 15 are properly inserted. The spokes 15 are manufactured from a sturdy material, in this embodiment stainless steel, and finished such that the spokes 15 have a high gloss.

To assemble the spokes 15, the stem hub 26 and top ring 68, the spokes 15 are inserted beyond their normal assembly position into the spoke inner holes 64. When the spoke first ends 17 have been biased into the spoke inner holes 64, the top ring 68 is then attached.

The top ring 68 is circular in shape. A plurality of spoke outer holes 67 are perpendicular to a wall inner surface 31 and engage the spoke 15 second spoke end 18. Above the spoke outer holes 67 is a shelf 61. The shelf 61 creates a ring shaped planar surface approximately perpendicular to the wall inner surface 31 extending from the wall inner surface 31 towards the outer surface 100. A lip 30 is located perpendicular to the shelf 61 and on the circumference of the top ring 68 between the shelf 61 and the outer surface 100. The lip 30 provides a barrier to prevent articles from sliding off the cover plate 12.

The top ring 68 is placed around the spokes 15 such that the stem hub 26 is centered in the top ring 68 and the second spoke ends 18 align with the spoke outer holes 34. The spokes 15 second spoke ends 18 are then inserted into the top ring 68 spoke outer holes 34. This fixedly attaches the top ring 68, the spokes 15, and the stem hub 26 together.

A plurality of glass plates 13 plate bottom surfaces 21 rest adjacent to the spoke 15 top surface 20. The glass plates 13 are primarily rectangular in shape and of a predetermined thickness.

The glass plates 13 can be multicolored as desired and are arranged, in this embodiment, in a maze pattern. The glass plates 13 create a continuous surface between the hub outer surface 29 and the wall inner surface 31. Other arrangements of the glass plates and other multiple color combinations can be used. The glass plates 13 are flush against one another such that all light that penetrates the glass plates 13 takes on a color of the plate through which it passes.

In one arrangement the glass plates 13, the glass plates 13 are arranged in a maze pattern where the plates 13 closest to the top cap 65 are narrower than the plates 13 nearest the wall inner surface 31. Other embodiments and arrangements of glass plates 13 can be used.

A circular cover plate 12 with a round central hole 32 is placed such that the cover bottom surface 23 rests adjacent to the stem hub 26 top surface 57 and the top ring 68 shelf 61. The central hole 32 is located over the stem hub 26 cap hole 56. The cover plate 12 is manufactured from a transparent material, in this embodiment clear glass, and is of a predetermined thickness. A space exists between the glass plates 13 and the cover plate 12 cover bottom surface 23.

Between the cover plate 12 cover bottom surface 23 and the shelf 31, there is a damping material 67 to provide a soft contact surface for the cover plate 12.

A circular top cap 65 with an attachment screw 66 is removably attached to the cap hole 56 centrally located in the stem hub 26 top surface 57. The top cap 65 has a dome shaped upper surface and a flat lower surface with an attachment screw 66 centrally affixed to the lower surface. The top cap 65 has a diameter larger than the diameter of the stem hub 26 such that the stem hub 26 is substantially hidden from view when the top cap 65 is affixed and the rotating illuminating table is viewed from above. The top cap 65 securely attaches the cover plate 12 to the top ring 68 shelf 61 and the stem hub 26 top surface 57. The top cap 65 attachment screw 66 is screwed into the stem hub 26 cap hole 56 and snugly tightened against the cover plate 12.

Damping material 67 is placed between the top cap 65 and the cover top surface 24 of the cover plate 12 and between the cover bottom surface 23 and the top surface 57 of the stem hub 26.

The top portion 11 is slidably affixed to the first end 27 of the stem portion 25. The first end 27 of the stem portion 25 is inserted into the stem hole 44 of the stem hub 26. The top portion 11 is rotatable relative to the fixed position stem portion 25.

The second end 28 of the stem portion 25 is fixedly attached to the lower base member 47 of the base portion 35. The lower base member 47 is a circular plate having a circumference that lies flush with the also circular opening of the lower edge 111 of the base portion 35 such that the lower base member 47 is coplanar with the base portion 35.

A support rib 37 is fixedly attached to the stem portion 25 between the first end 27 and the second end 28. The support rib 37 is a plate of predetermined width having a sloping top surface 90 and a flat bottom surface 91, a first end 92, a second end 93, and an attachment hole 94 of a size to accommodate the stem portion 25. The support rib 37 is located midway between the first end 92 and the second end 93 of the stem portion 25. The support rib 37 is located on the stem portion 25 such that the base portion 35 upper edge 110 contacts the support rib 37 first end 92 and second end 93, and the base portion 35 lower edge 111 contacts the lower base member 47 circumferentially.

The base portion 35 is removably attached to the support rib 37 and the lower bases member 47 to allow access to the rotation means 39 and the illumination means 38. The support rib 37 first end 92 and the second end 93 are tapered, and the lower base member 47 is centrally fitted with a cylindrical flange 70 that allows for a sleeve insertion of the lower shank end 69 of the second end 28 of the stem portion 25. The base portion 35 is lifted directly up parallel to the stem portion 25 if access is needed.

A stem base mount 42 is affixed to the cylindrical flange. The stem base mount 42 is rectangular and cubic in shape, and can be made from any rigid material, in this embodiment, wood. The stem base mount 42 is split down the middle with a semicircular void in each half of a size to accommodate the cylindrical flange 70. Each half of the stem base mount 42 is affixed around the cylindrical flange 70 and affixed together by attachment means. The stem base mount 42 rests on the lower base member 47. A mount washer 44 is affixed to the top of the stem base mount 42 by an attachment means.

An anti-friction means, in this embodiment, a bearing 50, is freely located between the mount washer 44 and the driven gear 41. A split washer 45 is fixedly attached to the gear top 72 of the driven gear 41. The driven gear 41 meshes with the drive gear 40. The drive gear 40 is affixed to the rotation means 39. The rotation means is mounted to the bottom surface 73 of the mount washer 44 such that the drive gear 40 and the driven gear 41 mesh.

Many different gear ratios could be used. This embodiment utilizes a rotational speed of one revolution per minute, and the drive gear 40 and the driven gear 41 are of equal size. The mount washer 44, bearing 50, driven gear 41 and split washer 45 all have a centrally located hole of a size to accommodate the stem portion 25 through which the second end 28 of the stem portion 25 is inserted.

A pair of mounting flats 55 having a first and second ends are affixed to the split washer 45 a predetermined distance apart in a configuration parallel to one another. The mounting flats 55 have a pair of mounting holes from the top to the bottom to which are affixed the base of elongated nuts 54.

One elongated nut 54 is affixed by the threaded attachment hole to each end of the mounting flats 55 top. Once the elongated nuts 54 are affixed to the mounting flat 55 ends, each threaded rod 53 is inserted through the threaded rod hole in two of the elongated nuts 54. The threaded rods 53 are configured perpendicular to the mounting flats 55. Each end of the threaded rods 53 is affixed to a band support 52. The band support 52 has a corresponding hole which matches the threaded rods 53.

The band support 53 is rigidly attached to a band interior 62 of a circular band 51. The circular band 51 has a predetermined height and is of a diameter small enough to be fully contained within the base portion 35 yet larger than the opening created by the base portion 35 upper edge 110.

The elongated nuts 54 and the band support 52 are arranged such that the top of the band support 52 and the cap 107 of the elongated nuts 54 are in the same plane and provide a planar support surface for a chip surface 36.

The chip surface 36 is manufactured from a transparent rigid material, in this embodiment clear glass. The chip surface 36 is divided into two pieces for assembly purposes, and has a retaining ring 78 affixed to a chip top to prevent the glass pieces 76 from lodging in the drive gear 40 and the driven gear 41. The circular band 51 also has a retention lip 63 which extends above the plane of the chip surface 36 to prevent the glass pieces 76 from falling off the edge of the chip surface 36.

A Y-shaped member 43 is affixed to a mounting block 71. The mounting block 71 is rectangular in shape and made of any rigid material, in this embodiment wood. The mounting block 71 is slideably affixed to the lower cross member 47. The Y-shaped member 43 houses the illumination means, in this embodiment light bulbs. The mounting block 71 is slideably affixed to the lower cross member 47 so that the mounting block 71 can be moved to allow easier access to the illumination means 38. The illumination means 38 are each centrally positioned, in this embodiment, at two sides of the stem base mount 42 so that the maximum amount of light radiates towards the top portion 11.

The glass pieces 76 are randomly located on top of the chip surface 36. The glass pieces 76 can be of any color and shape. The glass pieces 76 change the color of the passing light and also function to conceal the rotation means 39 and other components inside the base portion 35.

OPERATION

When the rotation means 39 is energized the rotation means 39 begins to rotate causing the drive gear 40 and the driven gear 41 to rotate and the illumination means 38 to light up. The split washer 45, the mounting flats 55, elongated nuts 54, threaded rod 53, band support 52, circular band 51, chip surface 36, and glass pieces 76 all begin to rotate together at the same speed relative to the base portion 35 and the stem portion 25.

As the assembly rotates, the glass pieces 76 rotate over the illumination means 38. As the light from the illumination means 38 passes through the glass pieces 76, the light takes on the color of the glass piece 76 through which it passes. The light continues up towards the top portion 11 where it passes through the spoke space 77. The light passes through the glass plates 13 where it takes on the color of the glass plate 13 which is combined with the color of the glass pieces 76 through which it already passed. The light continues through the cover plate 12 to illuminate objects on the surface of the cover plate 12 cover top surface 24 and continues until it reaches a surface on which to project such as a ceiling.

As the chip surface 36 with the glass pieces 76 rotates across the illumination means 38, the light takes on various colors and projects primarily up but at different random angles creating an interesting visual affect on the objects on the cover plate 12 and the room and ceiling in which the rotating illuminating table is utilized.

The top portion 11 can also be rotated by hand relative to the stem portion 11 and the base portion 35 again enhancing the changing visual affect or to grasp an article from the opposite side of the cover top surface 24.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

I claim:

1. A rotating illuminating table, comprising:

a circular top portion;

a circular base portion containing a rotating and illuminating means which respectively supports and projects light upward through a transparent and colorless circular glass platform upon which rests a plurality of colored pieces of glass; and a stem portion interconnecting said top portion and said base portion.

2. The rotating illuminating table of claim 1, wherein:

said circular top portion has a circumferential ring with a side inner surface connected to a circular stem hub by means of a plurality of inset spokes, upon which rests a plurality of colored glass plates, wherein said circumferential ring is connected to said stem hub by means of said spokes and supports a transparent and colorless glass cover plate defining a top surface resting immediately above and separate from said colored glass plates.

3. The rotating illuminating table of claim 2, wherein:

said illuminating means projects a plurality of colors and patterns of said glass pieces rotatably upward through said circular top portion.

4. The rotating illuminating table of claim 3, wherein:

said plurality of spokes are axially arranged equidistant from one another and fixedly sleeve fitted at a first end into matching receptor holes fully traversing side walls of said stem hub and likewise fitted at a second end into receptor holes partially inset to a predetermined depth within said inner surface of said circumferential ring.

5. The rotating illuminating table of claim 4, wherein:

said means for illumination is a predetermined number of incandescent light bulbs fixedly attached near a base portion bottom such that light is emitted upward thereby penetrating said colored glass pieces resting on said glass platform, thereby projecting further upward between said spokes and through said top portion, thereby further illuminating said colored glass plates and objects on and above said cover plate.

6. A rotating illuminating table comprising:

a circular top portion having a transparent and colorless cover plate comprising a top support surface above and separate from a plurality of spokes comprising a lower support surface, each spoke having a first spoke end and a second spoke end, a ring side wall circumferentially surrounding said top support surface and said lower support surface and fixedly attached to each second spoke end, a plurality of colored glass plates resting on said spokes by means of gravity and forming a contiguously edged geometric pattern;

a circular base portion having a circular top opening, a circumferential side wall, a circumferential bottom plate surface supporting a means for rotation and illumination, and a centrally positioned collar fixedly attached to said circumferential bottom plate;

a stem portion in a generally cylindrical shape and having a plurality of concentric diameters with a first end rotatably sleeve fitted into and supporting a stem hub with side walls, and with a second end inserted into and fixedly attached to said centrally positioned bottom plate collar, thereby permitting manual rotation of said top portion.

7. The rotating illuminating table of claim 6, wherein:

said stem hub contains a plurality of close tolerance receptor holes fully traversing said cylindrical side walls, each said receptor hole being adapted to receive the first end of a spoke; and said circumferential ring contains a corresponding plurality of close tolerance receptor holes, each said receptor hole being adapted to receive the second end of a spoke.

8. The rotating illuminating table of claim 7, wherein:

said base portion has a supporting rib extending across and centrally bisecting the top circular opening of said base portion, said support rib having a stem hole midway from an end for fixedly supporting said stem portion at an intermediate point between first end and second of said stem portion, said rib having ends which are circularly curved and beveled to fully contact a circular edge of said top circular opening thereby providing a fixed gravity compression lock.

* * * * *